US012768260B2

(12) United States Patent
Marica

(10) Patent No.: US 12,768,260 B2
(45) Date of Patent: Oct. 20, 2026

(54) AUTOMATED TRIPPING OPERATION IN A WELL SYSTEM USING ENCODERS FOR MULTI-DIMENSIONAL DATA ACQUISITION

(71) Applicant: Halliburton Energy Services, Inc., Houston, TX (US)

(72) Inventor: Adrian Marica, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/093,018

(22) Filed: Mar. 27, 2025

(65) Prior Publication Data

US 2026/0298068 A1 Oct. 1, 2026

(51) Int. Cl.
*E21B 44/00* (2006.01)
*E21B 19/16* (2006.01)

(52) U.S. Cl.
CPC ..... *E21B 44/00* (2013.01); *E21B 19/165* (2013.01)

(58) Field of Classification Search
CPC ..... E21B 44/00; E21B 19/165
See application file for complete search history.

(56) References Cited

U.S. PATENT DOCUMENTS 6,273,454 B1 * 8/2001 Olivas ..... B60R 21/2171 280/728.2
6,367,557 B1 * 4/2002 Rosine ..... E21B 19/22 166/85.1
7,631,581 B2 12/2009 Bangert
2004/0262015 A1 12/2004 Mazzella et al.
2006/0096754 A1 * 5/2006 Weightmann ..... E21B 19/22 166/77.3
2010/0243325 A1 * 9/2010 Veeningen ..... E21B 47/12 175/40
2014/0124218 A1 * 5/2014 Pilgrim ..... E21B 17/01 166/380
2017/0260817 A1 * 9/2017 Dobkins ..... E21B 19/08
2018/0216424 A1 8/2018 Pilgrim et al.
2019/0078401 A1 3/2019 Knowlton
2022/0145710 A1 * 5/2022 Saunders ..... E21B 44/00
2023/0366278 A1 11/2023 Annaiyappa
2025/0129679 A1 * 4/2025 Ogundare ..... E21B 21/08

FOREIGN PATENT DOCUMENTS

CN 110259396 B 10/2020
WO 2014007790 A1 1/2014
WO 2017133561 A1 8/2017

OTHER PUBLICATIONS

International Patent Application No. PCT/US2025/024482, International Search Report and Written Opinion mailed Dec. 19, 2025, 11 pages.

* cited by examiner

*Primary Examiner* — Yanick A Akaragwe
(74) *Attorney, Agent, or Firm* — Kilpatrick Townsend & Stockton LLP

(57) ABSTRACT

A system can be used to facilitate an automated tripping operation. The system can include a subsystem and a set of encoders. The subsystem can include a coiled tubing or a hydraulic workover. The subsystem can be positioned in a well system that includes a wellbore. The subsystem can include a set of subcomponents to facilitate the automated tripping operation with respect to the wellbore. The set of encoders can be positioned in the subsystem and can be distributed among the set of subcomponents to facilitate multi-dimensional data acquisition about the subsystem for controlling the automated tripping operation.

17 Claims, 7 Drawing Sheets

AUTOMATED TRIPPING OPERATION IN A WELL SYSTEM USING ENCODERS FOR MULTI-DIMENSIONAL DATA ACQUISITION

TECHNICAL FIELD

The present disclosure relates generally to wellbore operations and, more particularly (although not necessarily exclusively), to an automated tripping operation that can be performed in a well system using encoders that can be used for multi-dimensional data acquisition.

BACKGROUND

Wellbore operations may include various equipment, components, methods, or techniques to perform various tasks, such as positioning components, with respect to a wellbore. In some examples, the wellbore operations may involve positioning a subsystem, such as a hydraulic workover subsystem, a coiled tubing subsystem, a well tool thereof, etc., in a wellbore or remove it from the wellbore. It may be difficult to track multiple different measurements or data points about the subsystem while the subsystem is being positioned in the wellbore or is being removed from the wellbore.

DETAILED DESCRIPTION

Figure 1:
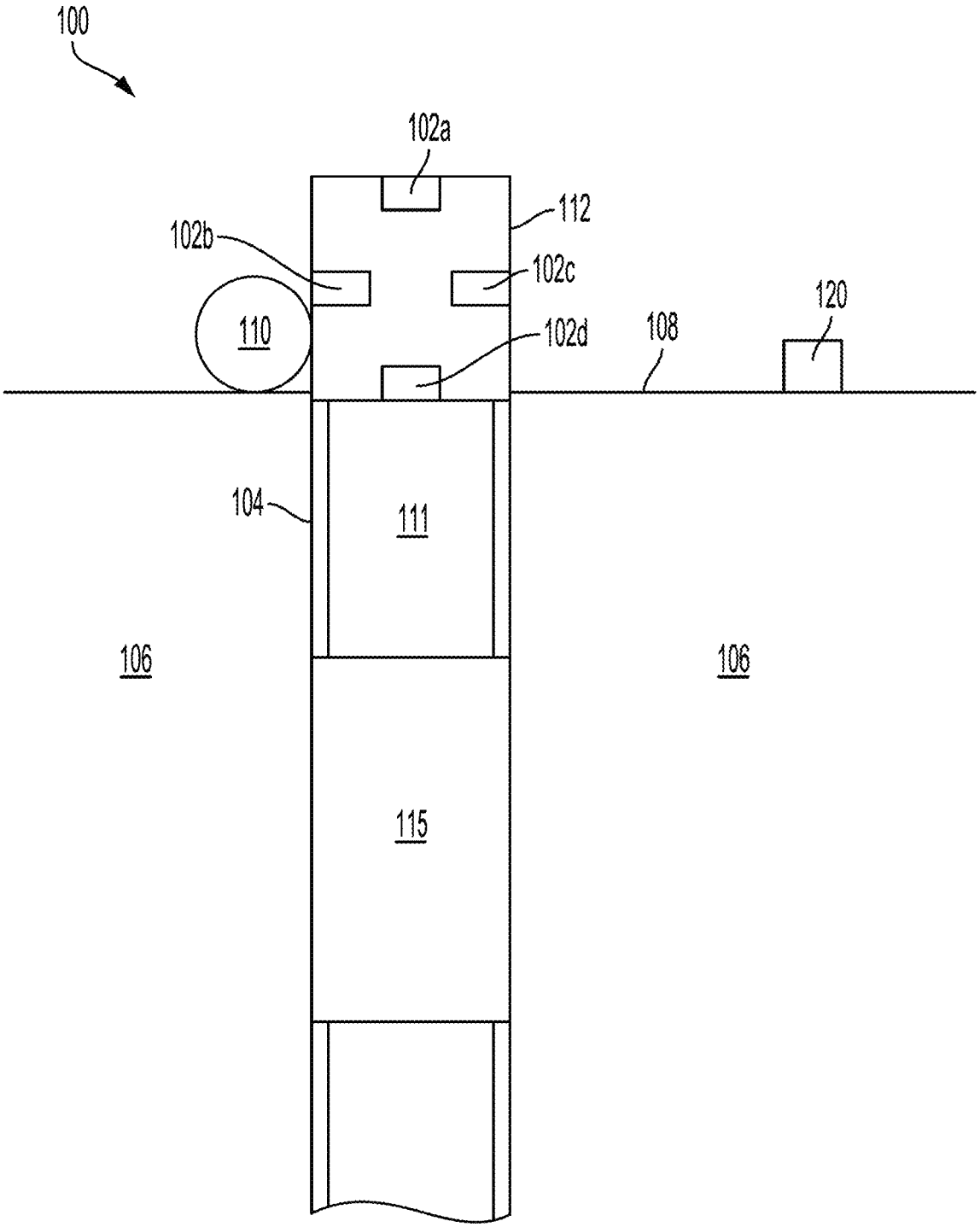
FIG. 1 is a diagram of a well system that can include encoders to facilitate an automated tripping operation according to some aspects of the present disclosure.

Certain aspects and examples of the present disclosure relate to an automated tripping operation in a well system that can be performed using encoders that can be used for multi-dimensional data acquisition. The well system can include a wellbore that may be formed in a subterranean formation or a suboceanic formation for extracting material such as hydrocarbon material, water, brine, or the like. A tripping operation can involve using a subsystem to position one or more well tools or other items into the wellbore, can involve using the subsystem to remove the one or more well tools or other items from the wellbore, can involve using the subsystem to reposition the one or more well tools or other items within the wellbore, or any combination thereof. An automated tripping operation can involve a tripping operation for positioning, such as positioning in or within, removing from, etc., the one or more well tools or other items with respect to the wellbore without manual intervention. The automated tripping operation may use results from the multi-dimensional data acquisition to control certain aspects, such as speed, depth, etc., of the automated tripping operation. In some examples, the results of the multi-dimensional data acquisition can include data about a diameter of a tubular, such as a pipe, of the one or more subsystems, about a displacement of the tubular, about a distance in a particular direction of the tubular, about other suitable multi-dimensional measurements of the one or more subsystems, or any combination thereof. The encoders can be positioned on one or more components or subcomponents of a subsystem that is positioned with respect to the wellbore using the automated tripping operation. In some examples, the encoders may be or include sensors that can perform or facilitate data acquisition in multiple dimensions. For example, the encoders can track a diameter of the pipe and a position, such as a displacement or distance and direction, of the pipe in the wellbore such as during the automated tripping operation.

Intelligent or automated pipe tripping techniques in a well system, such as a hydraulic workover subsystem, a coiled tubing subsystem, or other suitable type of rig, can involve knowing at any moment a depth of a pipe string relative to various markers. Some parameters involved in the tripping techniques can include total depth, depth relative to slip bowls or relative to the strippers, etc. Additionally or alternatively, such as with respect to a hydraulic workover unit, a stroke of hydraulic jacks, or jack rods, of the hydraulic workover may be known or measured. In some examples, the stroke may be or include lengths relative to a fixed marker. Other techniques involve placing proximity sensors at various markers or locations. However, these techniques do not measure the actual length or other parameters-of-interest. Proximity sensors confirm that a certain marker was reached without providing the substantially contemporaneous length or depth reached by the pipe string or jack stroke. The other techniques may also involve pull-string distance sensors. In these cases, the pull-string distance sensor's body can be attached to a fixed component while the string's end is attached to a travelling component. The length of the string can be converted into electrical parameters that can be communicated to a managing electronic controller. But, the pull string sensors may have a limited service life and are sensitive to dust and water intrusion that can skew or otherwise render useless the data. Additionally or alternatively, the other techniques can involve using laser sensors or ultrasound sensors. The laser sensor and the ultrasound sensors may encounter signal distortion due to operator presence, humid environment, or reflectivity due to wet surfaces.

One or more encoders can be positioned on a subsystem, such as a hydraulic workover, a coiled tubing, or other suitable subsystem, that can be positioned with respect to the wellbore in an automated tripping operation. An encoder can include a sensor that can measure angular displacements, that can facilitate a linear distance measurement, or a combination thereof. For example, the encoder can be converted to a sensor that can measure a linear distance in the wellbore. In some examples, the subsystem can include one or more jacks, and the one or more encoders can be attached to a rod of the one or more jacks to continuously measure a stroke of the one or more jacks. Additionally or alternatively, the one or more encoders can be positioned along a pipe of the subsystem, and the one or more encoders can continuously measure a diameter of the pipe. Additionally or alternatively, the one or more encoders can be strategically placed along a pipe string of the subsystem to continuously measure a length of the pipe. In some examples, the one or more encoders can continuously measure pipe length, total pipe length or depth, a particular joint's location, or any combination thereof substantially contemporaneously with respect to any motion of the subsystem. The one or more encoders can provide accurate multi-dimensional data to facilitate accurate and efficient decisions for controlling the automated tripping operation regardless of ambient disturbances such as light, vibrations, humidity, etc.

In some examples, an arrangement of the encoders can improve over other systems and techniques by allowing the encoders to function as linear distance measuring devices in an intelligent hydraulic workover or rig. The encoders can be positioned on jacks to determine an instantaneous stroke of the respective jacks, and the encoders can be used to determine an instantaneous change in diameter, or to determine the actual diameter, along a pipe string. The encoders can be positioned along the pipe to determine a length or position of the pipe as the pipe travels linearly. Additionally or alternatively, the encoders can be positioned at strategic or certain locations within a hydraulic workover subsystem to determine a length or position of various pipe joints, of various pipe string components, or of a combination thereof. The encoders can be used to make instantaneous measurements during a tripping operation that may not have been previously possible in other systems or techniques. The encoders can be used to provide information to determine a location of a joint relative to a blowout preventer. Additionally or alternatively, a location of the joint can be displayed on an electronic monitor or other display based on a length or linear dimension provided by the encoders.

In some examples, encoders, which may be adapted to make linear measurements instead of, or in addition to, angular measurements, can be integrated into a subsystem for performing multi-dimensional data acquisition with respect to the subsystem or any component thereof. The encoders can be integrated into one or more data acquisition devices that can be positioned within, or along, the subsystem. In some examples, the one or more data acquisition devices can determine a diameter of a pipe of the subsystem, can determine instantaneous changes of the diameter, can determine a speed of linear movement of the subsystem or any component thereof, can determine a rate-of-change of the speed of the subsystem or any component thereof, etc. The one or more data acquisition devices can be arranged to perform multi-dimensional data acquisition about cylindrical objects such as rods, pipes, and the like.

In some examples, the one or more data acquisition devices, or the encoders thereof, can be positioned at (i) a jack rod, (ii) a traveling bowl, (iii) a fixed bowl, (iv) a base plate, at other suitable components of the subsystem, or at any combination thereof. Encoders positioned at the jack rod can be arranged to measure a diameter of a rod of the subsystem, a displacement of the rod, or a combination thereof. Encoders positioned at the traveling bowl may be arranged to measure an incoming pipe diameter and instantaneous changes thereof. Encoders positioned at the fixed bowl can be arranged to measure a diameter of a pipe, instantaneous changes thereof, linear displacement and a direction thereof, incremental speed, or any combination thereof. Encoders positioned at the base plate may be arranged to measure a diameter of a pipe, instantaneous changes thereof, linear displacement and a direction thereof, incremental speed, or any combination thereof.

The parameters listed above may be continuously measured and provided to a controller of the subsystem. The controller can adjust certain parameters of an automated tripping operation for positioning a pipe, a well tool, or other item associated with the subsystem with respect to the wellbore. For example, the controller may increase (or decrease) a speed at which the pipe, the well tool, or the other item associated with the subsystem is moved within the wellbore, may adjust a displacement (or movement direction) of the pipe, the well tool, or the other item associated with the subsystem within the wellbore, etc. In some examples, the data about the parameters acquired using the encoders can be displayed on a monitor device for facilitating decisions for the automated tripping operation.

In some examples, the data about the parameters acquired using the encoders can be used as an input to one or more decision algorithms for allowing the controller to control the automated tripping operation. The encoders positioned at the jack rod can provide an instantaneous stroke and available stroke that can be used to determine when to load another length of pipe and the length thereof to use. Additionally or alternatively, the encoders positioned at the traveling bowl can provide a presence of pipe, such as whether a pipe exists at a particular location, and a speed and direction of motion which can be used to establish presence of a joint pipe and to determine whether a pipe is slipping or off-weight. Additionally or alternatively, the encoders positioned at the fixed bowl can provide data or measurements about joint location, availability of pipe, and speed and direction of motion. Additionally or alternatively, the encoders positioned at the base plate can provide data or measurements about joint location (actual and estimates), relative joint location, such as with respect to a blowout preventer, availability of pipe, etc.

In some examples, such as examples in which encoders are not available, the encoders can be replaced with linear displacement transducers of various constructions. The linear displacement transducers can be or include inductive or conductive plastic potentiometers. In some examples, the linear displacement transducers can be used in addition to the encoders to provide more accurate or efficient multi-dimension data. Additionally or alternatively, a data acquisition device can be formed with the encoders and linear moving actuators that use electricity, pneumatic force, or hydraulic force. The linear moving actuator can include or incorporate a linear displacement transducer.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure. As used herein, approximately indicates that a recited value may vary, such as above or below, by 1%, 2%, 3%, 4%, 5%, from 5% to 10%, from 10% to 20%, and the like.

FIG. 1 is a diagram of a well system 100 that can include encoders to facilitate an automated tripping operation according to some aspects of the present disclosure. As illustrated in FIG. 1, the well system 100 can include a wellbore 104 formed in a formation 106, which may be or include a subterranean formation, a suboceanic formation, or other suitable formations. At a surface 108 of the wellbore 104, a tripping device 110 may be positioned to allow a string 111 to be lowered into the wellbore 104, to be removed from the wellbore 104, to be repositioned in the wellbore 104, or any combination thereof. In some examples, the string 111 can include or be positioned through a subsystem 112 that can be positioned at the surface 108 of the wellbore 104, or in other suitable locations, to perform or otherwise facilitate one or more wellbore operations. For example, the string 111 can include a well tool 115, such as one or more sensors, a drill bit, etc., that can facilitate a wellbore operation in the wellbore 104. The subsystem 112 can include a hydraulic workover unit that can include a set of encoders, a coiled tubing unit that include the set of encoders, other suitable devices, units, and the like, or any combination thereof to facilitate the one or more wellbore operations. In some examples, the subsystem 112 can include any other suitable subsystem that can be positioned on the well system 100 such as above the wellbore 104. Additionally or alternatively, the one or more wellbore operations can include an automatic tripping operation for positioning the well tool 115, or other suitable tools or components, in the wellbore 104, removing the well tool 115, or the other suitable tools or components, from the wellbore 104, etc.

As illustrated in FIG. 1, the subsystem 112 can include a set of encoders that can include a first encoder 102*a*, a second encoder 102*b*, a third encoder 102*c*, and a fourth encoder 102*d*. While four encoders are illustrated in FIG. 1, other suitable numbers, such as less than four or more than four, of encoders are possible to include in the subsystem 112. In some examples, the set of encoders can be positioned distributed within the subsystem 112 to facilitate multi-dimensional data acquisition about the subsystem 112, about the wellbore 104, about the string 111, about the well tool 115, or about any other portion of the well system 100, for example to facilitate the automatic tripping operation. The subsystem 112 can include a set of components or subcomponents that can provide functionality for the subsystem 112 and that can be used as a surface for receiving the set of encoders. In examples in which the subsystem 112 is a hydraulic workover unit, the set of components of the subsystem 112 can include one or more hydraulic jacks, a traveling bowl, a fixed bowl, and a base plate, though any additional, alternative, or fewer components for the subsystem 112 are possible.

Each encoder of the set of encoders can be positioned at a different component of the set of components of the subsystem 112. In some examples, more than one encoder of the set of encoders may be positioned at a particular component of the set of components. The number of encoders positioned at the particular component may be determined based on data intended to be acquired using encoders at the particular component. For example, one or more first encoders of the set of encoders can be positioned at a hydraulic jack of the subsystem 112 to provide a first type of data via first multi-dimensional acquisition involving the subsystem 112, one or more second encoders of the set of encoders can be positioned at a traveling bowl of the subsystem 112 to provide a second type of data via second multi-dimensional data acquisition involving the subsystem 112, and so on.

The multi-dimensional data acquisition provided by the set of encoders can be used to control or otherwise facilitate an automated tripping operation. For example, results of the multi-dimensional data acquisition can be performed using the set of encoders and can be provided to a control unit 120 of the well system 100 for determining a speed of tripping, a length of tripping, a direction of tripping, or other suitable parameters of tripping. Additionally or alternatively, the results can be provided to the control unit 120 to determine whether an emergency stop is to be performed, whether a suitable displacement has been achieved for positioning the well tool 115 in the wellbore 104, etc. The results can be provided to the control unit 120, or to any other unit or device, for controlling or facilitating the automatic tripping operation.

Figure 2:
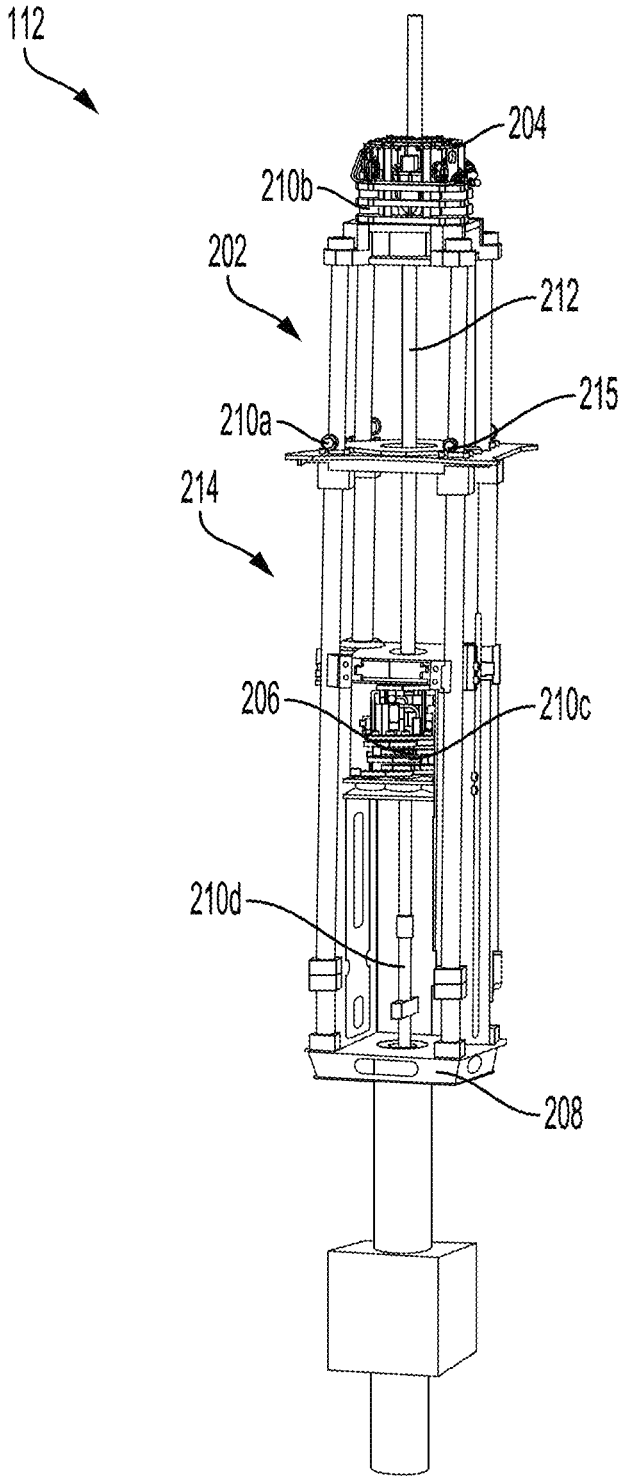
FIG. 2 is a diagram of a subsystem that includes encoders for facilitating an automated tripping operation according to some aspects of the present disclosure.

FIG. 2 is a diagram of a subsystem 112 that includes encoders for facilitating an automated tripping operation according to some aspects of the present disclosure. FIG. 2 illustrates the subsystem 112 as an example of a hydraulic workover unit, but the subsystem 112 can include any other suitable type of subsystem such as a coiled tubing unit, etc. As illustrated in FIG. 2, the subsystem 112 can include a set of components or subcomponents that can include a set of hydraulic jacks 202, a traveling bowl 204, a fixed bowl 206, and a base plate 208, though the subsystem 112 can include any additional, alternative, or fewer components for providing functionality for the subsystem 112. For example, the set of components of the subsystem 112 can allow the subsystem 112 to be used in a well system, such as the well system 100, for performing an automatic tripping operation. The subsystem 112 can additionally include a set of encoders, which can include a first encoder 210*a*, a second encoder 210*b*, a third encoder 210*c*, and a fourth encoder 210*d*, though the set of encoders can include any other suitable number, such as less than four or more than four, of encoders, that can be distributed among the set of components of the subsystem 112 to facilitate multi-dimensional data acquisition involving the subsystem 112 or other portions of the well system in which the subsystem 112 is disposed. In some examples, each encoder of the set of encoders, or any subset thereof, can be used to perform multi-dimensional data acquisition. Additionally or alternatively, results of the multi-dimensional data acquisition may be generated from a combination of measurements made by, or data gathered using, the set of encoders.

In some examples, the set of encoders can be distributed among the set of components of the subsystem 112. That is, at least one different encoder from the set of encoders can be positioned at a different component of the set of components of the subsystem 112. In an example, each component of the subsystem 112 can include, or be positioned adjacent, one encoder. In other examples, each component of the subsystem 112, or any subset thereof, can include, or be positioned adjacent, more than one encoder. The number of encoders positioned adjacent or on a respective component of the subsystem 112 may be determined based on a type of data to be gathered proximate to the respective component. For example, a first type of data gathered at the set of hydraulic jacks 202 may involve one encoder, while a second type of data gathered at the traveling bowl 204 may involve two or more encoders.

In some examples, the set of hydraulic jacks 202 can be located around a central axis 212 of the subsystem 112 and can be translated within a set of hydraulic cylinders 214 of the subsystem 112. The traveling bowl 204 may be located upstream with respect to a wellbore over which the subsystem 112 is disposed from the set of hydraulic jacks 202, and the traveling bowl 204 may travel up or down based on displacement of the set of hydraulic jacks 202 or rods thereof. The fixed bowl 206 may be located downstream from the set of hydraulic jacks 202, the traveling bowl 204, or a combination thereof, and the fixed bowl 206 may be coupled with a fixed structure, or other structure not subject to movement, of the subsystem 112. The base plate 208 may be located downstream from the set of hydraulic jacks 202, the traveling bowl 204, the fixed bowl 206, or any combination thereof. In some examples, the subsystem 112, or each component thereof, can be positioned over a blowout preventer and above the wellbore 104. Any other suitable arrangement of the components of the subsystem 112 for facilitating the automatic tripping operation is possible.

Figure 3:
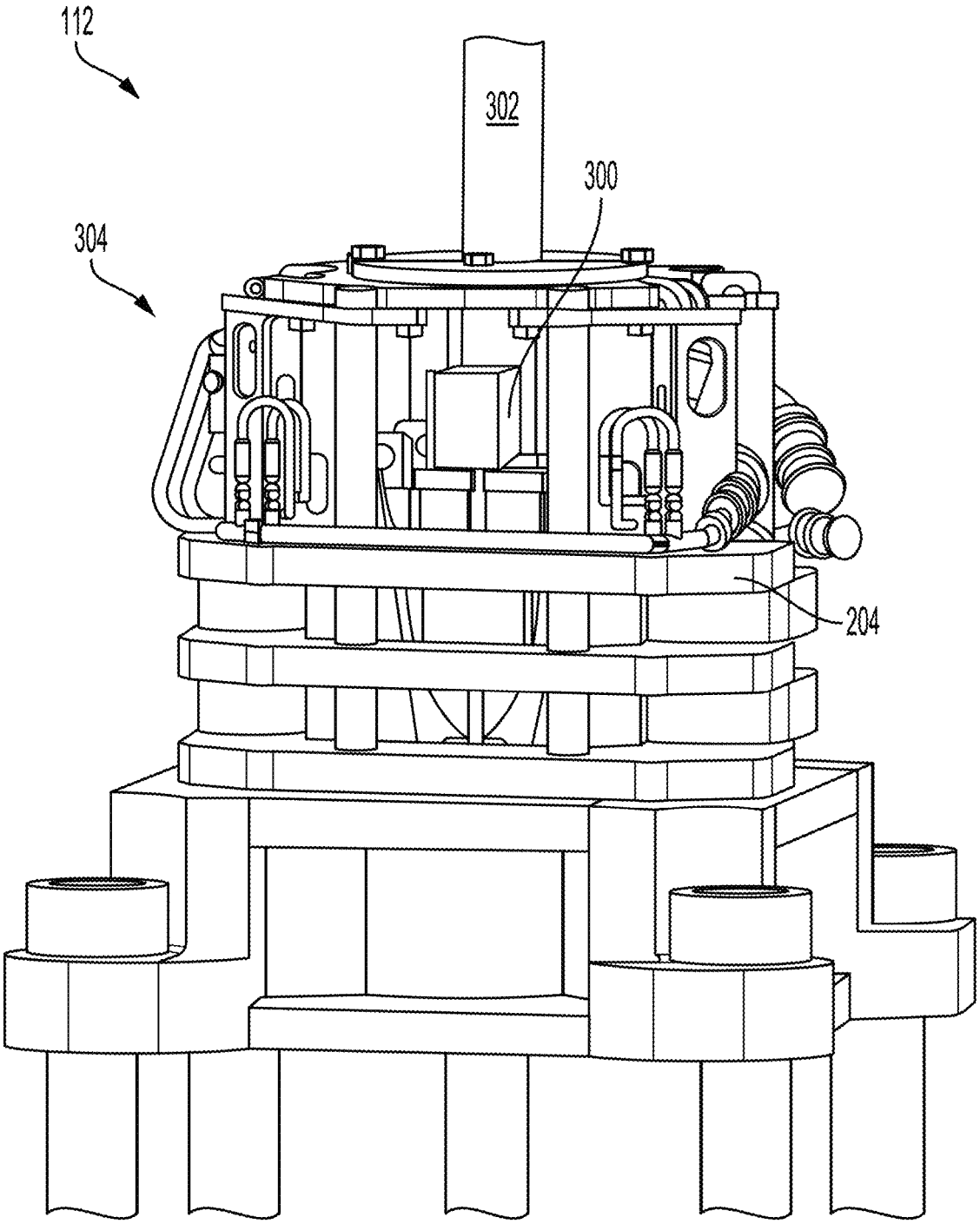
FIG. 3 is a diagram of a first component, that includes one or more encoders, of a subsystem that includes encoders for facilitating an automated tripping operation according to some aspects of the present disclosure.

FIG. 3 is a diagram of a first component, or a first subcomponent, that includes one or more encoders of a subsystem that includes encoders for facilitating an automated tripping operation according to some aspects of the present disclosure. As illustrated in FIG. 3, the first component includes the traveling bowl 204, though other components of the subsystem 112 may be used in place of the traveling bowl 204 as the first component. The first component may be located above the set of hydraulic jacks 202, though other locations for the first component are possible. In some examples, the first component may surround an incoming pipe 302 that is intended to be positioned in a wellbore, or intended to be removed from the wellbore. The first component may be sized to receive or allow passage of the incoming pipe 302 during the automatic tripping operation.

In some examples, the first component can include or can be located adjacent to at least one encoder such as an encoder 300, which may be similar or identical to the second encoder 210*b*. The encoder 300 can be positioned at an upper portion 304 of the first component, though other suitable locations on or adjacent to the first component are possible for the encoder 300. In some examples, the encoder 300 can be positioned adjacent to the first component and proximate to the incoming pipe 302, or a channel through which the incoming pipe 302 is intended to travel, for performing data acquisition involving the incoming pipe 302. Results of the data acquisition may be multi-dimensional, or may be combined with other data acquisition associated with other encoders of the subsystem 112 to generate the multi-dimensional data. In some examples, the encoder 300 positioned on or adjacent to the first component can be used to measure, or gather data about, a diameter of the incoming pipe 302, an instantaneous change in the diameter of the incoming pipe 302, other data, or any combination thereof.

Figure 4:
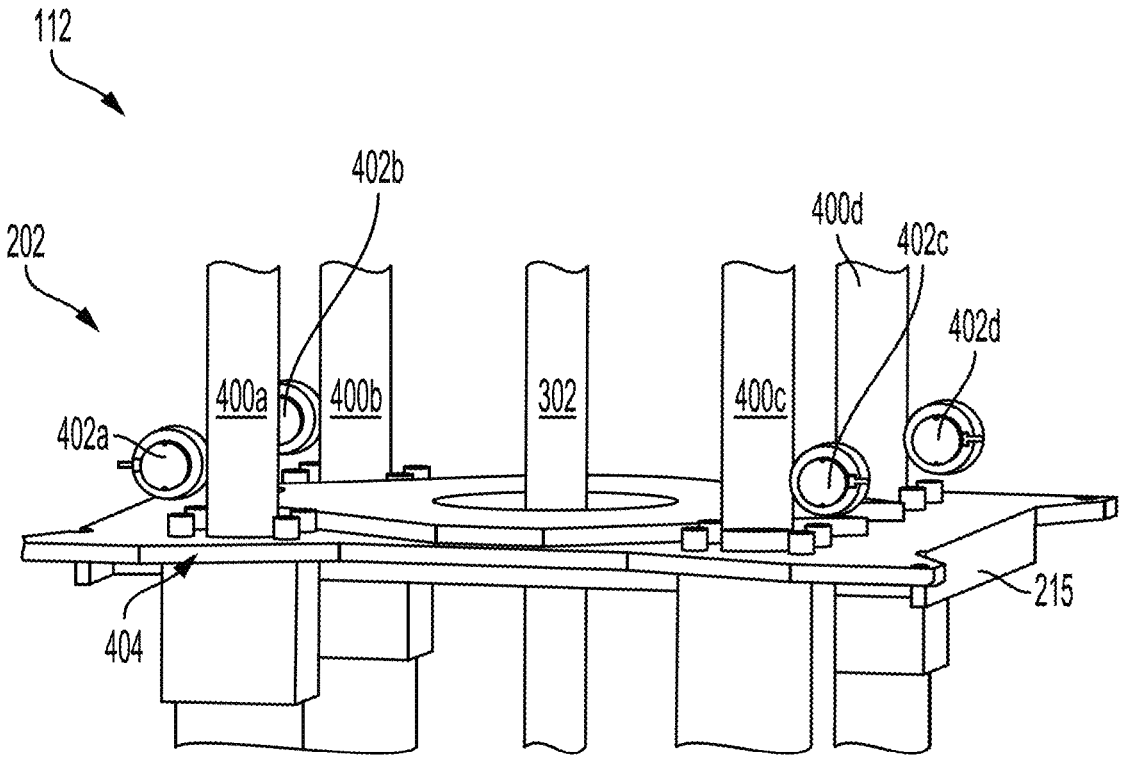
FIG. 4 is a diagram of a second component, that includes one or more encoders, of a subsystem that includes encoders for facilitating an automated tripping operation according to some aspects of the present disclosure.

FIG. 4 is a diagram of a second component, or a second subcomponent, that includes one or more encoders, of a subsystem that includes encoders for facilitating an automated tripping operation according to some aspects of the present disclosure. As illustrated in FIG. 4, the second component includes the set of hydraulic jacks 202, though other components of the subsystem 112 may be used in place of the set of hydraulic jacks 202 for the second component. The second component may be located below the first component, or the traveling bowl 204, though other locations for the second component are possible. In some examples, the second component may surround the incoming pipe 302 that is intended to be positioned in a wellbore or intended to be removed from the wellbore. For example, the second component can include a first hydraulic jack 400*a*, a second hydraulic jack 400*b*, a third hydraulic jack 400*c*, and a fourth hydraulic jack 400*d* positioned around the incoming pipe 302 or around a central axis of the subsystem 112.

In some examples, the second component can include or can be located adjacent to at least one encoder such as an encoder 402*a*, which may be similar or identical to the first encoder 210*a*. Additionally or alternatively, the encoder 402*a* may be a first encoder, and the second encoder can include a second encoder 402*b*, a third encoder 402*c*, and a fourth encoder 402*d*, though any other number, such as less than four or more than four, of encoders is possible to include in, or position adjacent to, the second component. The encoder 402*a* can be positioned at a lower portion 404 of the second component, such as a bottom portion of a respective hydraulic jack, though other suitable locations on or adjacent to the second component are possible for the encoder 402*a*. The remaining encoders may be positioned in similar locations adjacent to their respective hydraulic jacks. For example, the second encoder 402*b* can be positioned at a bottom portion of the second hydraulic jack 400*b*, the third encoder 402*c* can be positioned at a bottom portion of the third hydraulic jack 400*c*, and the fourth encoder 402*d* can be positioned at a bottom portion of the fourth hydraulic jack 400*d*. Other locations within the second component for any of the encoders are possible for facilitating multi-dimensional data acquisition involving the encoders.

In some examples, the encoder 402*a*, the second encoder 402*b*, the third encoder 402*c*, the fourth encoder 402*d*, or any combination thereof can be positioned adjacent to the second component and arranged to make measurements about, or facilitate data acquisition involving, a diameter of a respective hydraulic jack, a displacement of the respective hydraulic jack, other data acquisitions involving the subsystem 112, or any combination thereof. For example, the encoder 402*a* can be arranged in the subsystem 112 to perform data acquisition about a first diameter of the first hydraulic jack 400*a* and a first displacement of the first hydraulic jack 400*a*, the second encoder 402*b* can be arranged in the subsystem 112 to perform data acquisition about a second diameter of the second hydraulic jack 400*b* and a second displacement of the second hydraulic jack 400*b*, and so on. In some examples, the results of the data acquisition performed using by the encoder 402*a*, the second encoder 402*b*, the third encoder 402*c*, the fourth encoder 402*d*, or any combination thereof may be multi-dimensional, or may be combined with other data acquisitions from other encoders of the subsystem 112 to generate multi-dimensional data.

Figure 5:
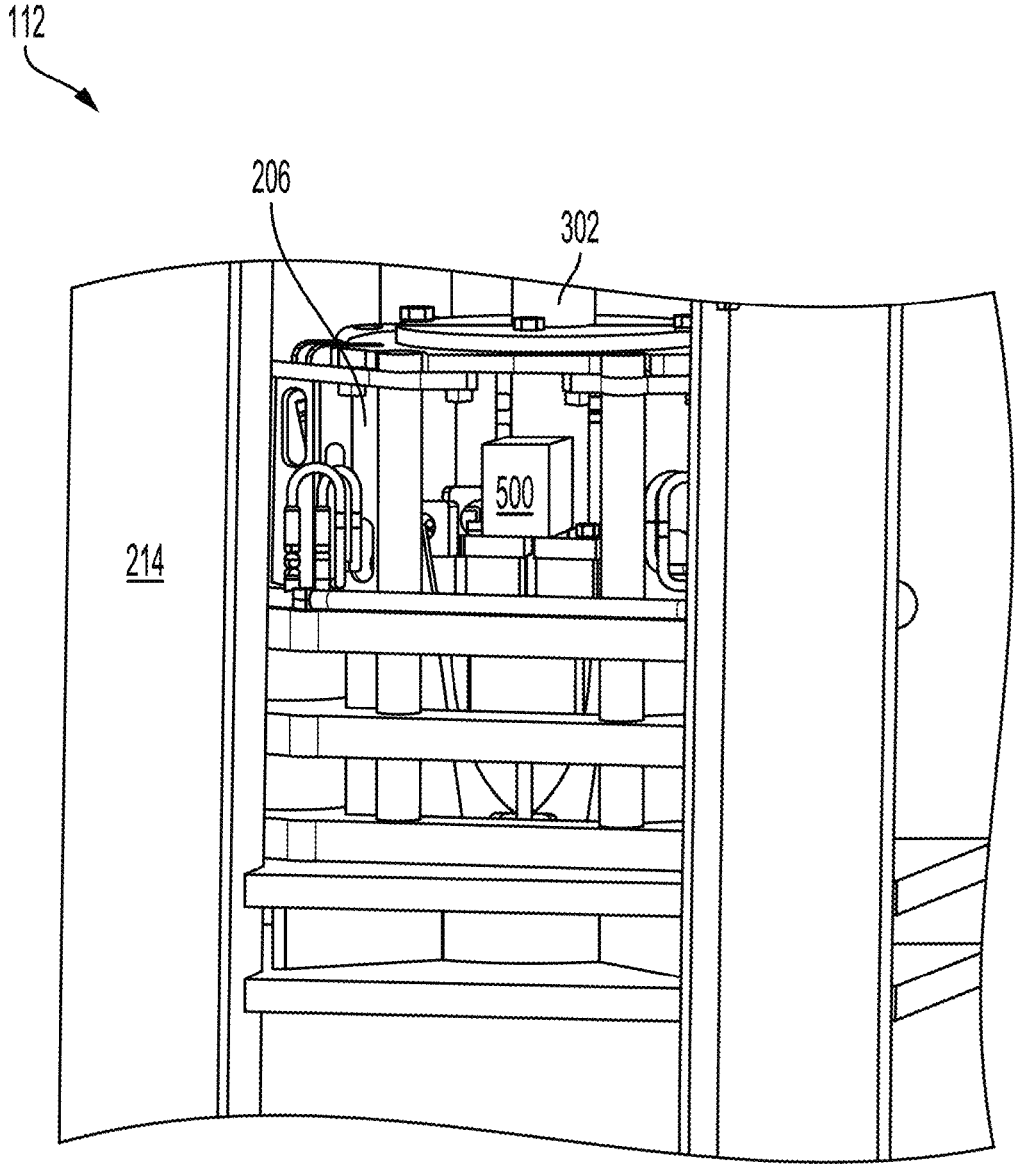
FIG. 5 is a diagram of a third component, that includes one or more encoders, of a subsystem that includes encoders for facilitating an automated tripping operation according to some aspects of the present disclosure.

FIG. 5 is a diagram of a third component, or a third subcomponent, that includes one or more encoders, of a subsystem that includes encoders for facilitating an automated tripping operation according to some aspects of the present disclosure. As illustrated in FIG. 5, the third component includes the fixed bowl 206, though other components of the subsystem 112 may be used in place of the fixed bowl 206 as the third component. The third component may be located above the set of hydraulic jacks 202, the traveling bowl 204, or any combination thereof, though other locations for the third component are possible. In some examples, the third component may surround an incoming pipe 302 that is intended to be positioned in a wellbore or intended to be removed from the wellbore. The third component may be sized to receive or allow passage of the incoming pipe 302 during the automatic tripping operation. Additionally or alternatively, the third component may be positioned within a diameter formed by the set of hydraulic cylinders 214.

In some examples, the third component can include or can be located adjacent to at least one encoder such as an encoder 500, which may be similar or identical to the third encoder 210*c*. The encoder 500 can be positioned on an outside or outer diameter location and at an upper portion 502 of the third component, though other suitable locations on or adjacent to the third component are possible for the encoder 500. In some examples, the encoder 500 can be positioned adjacent to the third component and proximate to the incoming pipe 302, or a channel through which the incoming pipe 302 is intended to travel, for performing data acquisition involving the incoming pipe 302. The results from the data acquisition may be multi-dimensional, or may be combined with other results from other data acquisitions involving other encoders of the subsystem 112 to generate the multi-dimensional data. In some examples, the encoder 500 positioned on or adjacent to the third component can measure, or facilitate data acquisition involving, a diameter of the incoming pipe 302, an instantaneous change of the diameter of the incoming pipe 302, a linear displacement of the incoming pipe 302, a direction of linear displacement of the incoming pipe 302, an incremental speed of movement of the incoming pipe 302, other data, or any combination thereof.

Figure 6:
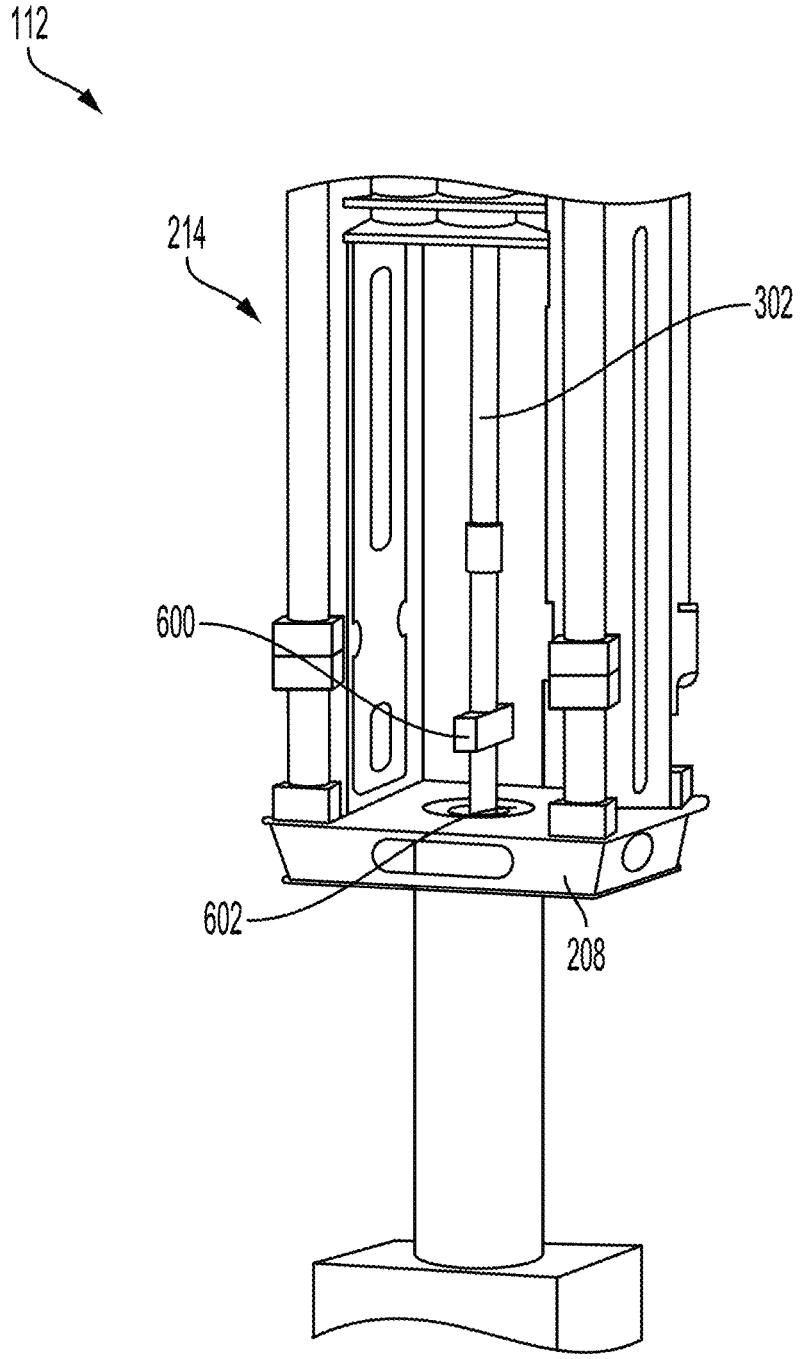
FIG. 6 is a diagram of a fourth component, that includes one or more encoders, of a subsystem that includes encoders for facilitating an automated tripping operation according to some aspects of the present disclosure.

FIG. 6 is a diagram of a fourth component, or a fourth subcomponent, that includes encoders, of a subsystem that includes encoders for facilitating an automated tripping operation according to some aspects of the present disclosure. As illustrated in FIG. 6, the fourth component includes the base plate 208, though other components of the subsystem 112 may be used in place of the base plate 208 as the fourth component. The fourth component may be located below the set of hydraulic jacks 202, the traveling bowl 204, the fixed bowl 206, the top plate 215, or any combination thereof, though other locations for the fourth component are possible. In some examples, the fourth component may surround an incoming pipe 302 that is intended to be positioned in a wellbore or intended to be removed from the wellbore. Alternatively, the fourth component may be sized to receive or allow passage, for example via a channel 602, of the incoming pipe 302 during the automatic tripping operation.

In some examples, the fourth component can include or can be located adjacent or proximate to at least one encoder such as an encoder 600, which may be similar or identical to the fourth encoder 210*d*. The encoder 600 can be positioned above the fourth component, such as adjacent to a lower portion 604 of the incoming pipe 302, though other suitable locations on, adjacent to, or proximate to the fourth component are possible for the encoder 600. In some examples, the encoder 600 can be positioned adjacent or proximate to, such as above, the fourth component and proximate to the incoming pipe 302, or a channel through which the incoming pipe 302 is intended to travel, for facilitating data acquisition about the incoming pipe 302 or other suitable components of the subsystem 112. The results of the data acquisition may be multi-dimensional, or may be combined with other results from other data acquisitions involving other encoders of the subsystem 112 to generate the multi-dimensional data. In some examples, the encoder 600 positioned on, adjacent to, or proximate to the fourth component can measure, or facilitate data acquisition involving, a diameter of the incoming pipe 302, an instantaneous change of the diameter of the incoming pipe 302, a linear displacement of the incoming pipe 302, a direction of linear displacement of the incoming pipe 302, an incremental speed of movement of the incoming pipe 302, other data, or any combination thereof. In some examples, the data acquisition using the base plate 208 can involve any suitable tubular rack, or pipe rack, or other subsystem that can be used to facilitate the operation of any workover unit, such as a hydraulic workover unit, continuous coiled tubing or other type of subsystem that can be positioned above the wellbore 104.

In some examples, the data acquisition performed using the set of encoders included in the subsystem 112 may be multi-dimensional. Multi-dimensional data acquisition can include measurements, or other gathered data, of different parameters of a common target, can include different instances, or locations, of data of common parameters of a common target, etc. For example, the encoder 600 can be used to perform multi-dimensional data acquisition by itself since the encoder 600 can be arranged in the subsystem 112 to measure, or acquire data about, multiple different parameters of the incoming pipe 302. The multiple different parameters of the incoming pipe 302 can include a diameter, an instantaneous change in diameter, a linear displacement, a direction of linear displacement, etc. Additionally or alternatively, the encoder 600, in combination with the encoder 500, can be used to perform multi-dimensional data acquisition since the encoder 500 and the encoder 600 can make measurements of, or acquire data relating to, common parameters of the incoming pipe 302 at different locations. The common parameters can include a diameter, an instantaneous change in diameter, a linear displacement, a direction of linear displacement, etc. In some examples, more data acquisitions than are disclosed herein can be performed. For example, while encoders are described as being positioned with respect to four different components of the subsystem 112, more than four data acquisitions may be performed.

Figure 7:
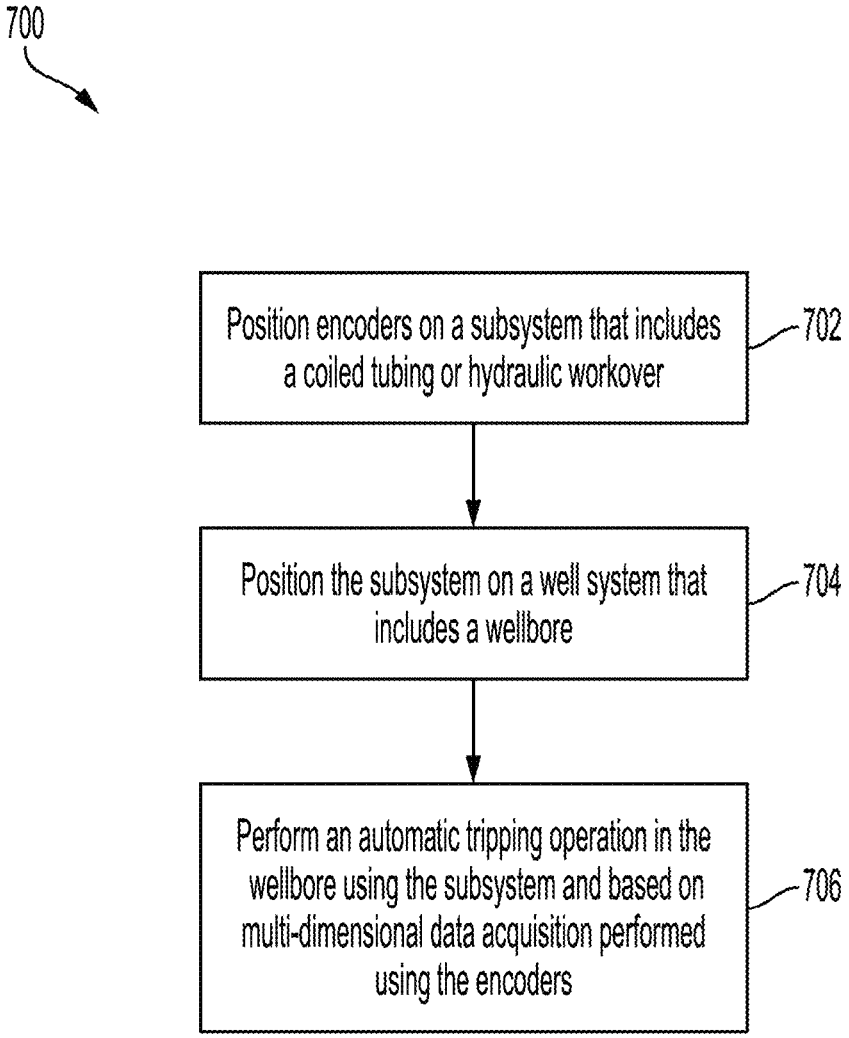
FIG. 7 is a flowchart of a process for performing multi-dimensional data acquisition with respect to a subsystem for automating a tripping operation in a wellbore according to some aspects of the present disclosure.

FIG. 7 is a flowchart of a process 700 for performing multi-dimensional data acquisition with respect to a subsystem 112 for automating a tripping operation in a wellbore 104 according to some aspects of the present disclosure. At block 702, a set of encoders is positioned on the subsystem 112. The set of encoders can include at least one encoder for each subcomponent of the subsystem 112, though more or fewer encoders is possible to include in the subsystem 112. The subsystem 112 may be or include a hydraulic workover unit, a coiled tubing unit, other suitable subsystems, or any combination thereof. The subsystem 112 can include a set of components or subcomponents, and the set of encoders can be positioned in the subsystem 112 distributed among the set of components or subcomponents.

At block 704, the subsystem 112 is positioned on a well system 100 that includes a wellbore 104. In some examples, the subsystem 112 can be positioned at a surface 108 of the wellbore 104 or the well system 100 such as above the wellbore 104, though other suitable locations for the subsystem 112 are possible. The subsystem 112 can be positioned on the well system 100 to facilitate one or more wellbore operations with respect to the wellbore 104.

At block 706, an automatic tripping operation is performed using the subsystem 112. In some examples, the automatic tripping operation can be performed to automatically position a well tool 115, or other suitable item or device, in the wellbore 104, remove the well tool 115, or other suitable item or device, from the wellbore 104, or to otherwise reposition the well tool 115, or other suitable item or device, with respect to the wellbore 104. The automatic tripping operation can be performed using input gathered from the set of encoders and may be able to proceed with minimal, or zero, interventions. The input gathered from the set of encoders can include results from multi-dimensional data acquisition about the subsystem 112 or about a pipe or other component thereof. For example, the input gathered using the set of encoders can include a diameter of a pipe, or an instantaneous change thereof, a linear displacement, and a direction thereof, of the pipe, a linear parameter, such as a pipe length, of the pipe, etc.

The input can be provided to a control unit that can change control parameters for the automatic tripping operation. In some examples, the control parameters can include a direction of displacement, a length of displacement, a speed of displacement, whether to stop the operation for maintenance or repair, a length parameter, etc. In some examples, one or more encoders can be placed onto a tubular rack, such as a pipe rack, or can otherwise be integrated in a handheld device associated with the tubular rack to determine the length of the tubular, or of the pipe. The one or more encoders can track the tubular, or the pipe, that goes into or out of the wellbore for performing data acquisition and for automating the tripping operation. Additionally or alternatively, the one or more encoders can be used to perform data acquisition about an elemental length of one or more sections of a tubular and an order of which the one or more sections of the tubular go into or out of the wellbore 104.

In some aspects, systems and methods for an automated tripping operation in a well system using encoders for multi-dimensional data acquisition are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a subsystem comprising a coiled tubing or a hydraulic workover positionable on a well system that includes a wellbore, the subsystem comprising a plurality of subcomponents to facilitate an automated tripping operation with respect to the wellbore; and a plurality of encoders positionable in the subsystem and distributable among the plurality of subcomponents to facilitate multi-dimensional data acquisition about the subsystem for controlling the automated tripping operation.

Example 2 is the system of example 1, wherein the plurality of subcomponents comprises a jack rod that is located at an upstream position of the subsystem with respect to the wellbore and between a traveling bowl and top plate of the subsystem, wherein a subset of the plurality of encoders is positioned adjacent to the jack rod, and wherein the subset of the plurality of encoders is arranged to be used to perform data acquisition about a diameter of the jack rod and a displacement of the jack rod with respect to the subsystem.

Example 3 is the system of example 1, wherein the plurality of subcomponents comprises a traveling bowl that is located at an upstream position of the subsystem above one or more jack rods of the subsystem, wherein a subset of the plurality of encoders is positioned adjacent to the traveling bowl, and wherein the subset of the plurality of encoders is arranged to be used to perform data acquisition about an instantaneous change in diameter of a pipe associated with the subsystem.

Example 4 is the system of example 1, wherein the plurality of subcomponents comprises a fixed bowl that is located between a top plate and a base plate of the subsystem, wherein a subset of the plurality of encoders is positioned adjacent to the fixed bowl, and wherein the subset of the plurality of encoders is arranged to be used to perform data acquisition about an instantaneous change in diameter of a pipe associated with the subsystem, about a direction and magnitude of linear displacement of the pipe, and about an incremental speed of motion of the pipe.

Example 5 is the system of example 1, wherein the plurality of subcomponents comprises a base plate that is located at a downstream end of the subsystem, wherein a subset of the plurality of encoders is positioned adjacent to the base plate, and wherein the subset of the plurality of encoders is arranged to be used to perform data acquisition about an instantaneous change in diameter of a pipe associated with the subsystem, about a direction and magnitude of linear displacement of the pipe, and about an incremental speed of motion of the pipe.

Example 6 is the system of example 1, wherein the plurality of subcomponents comprises: a plurality of hydraulic jacks located around a central axis and translatable within a plurality of hydraulic cylinders of the subsystem, wherein a first encoder of the plurality of encoders is positioned adjacent to the plurality of hydraulic jacks for performing a first data acquisition about the subsystem; a traveling bowl located upstream with respect to the wellbore from the plurality of hydraulic jacks, wherein a second encoder of the plurality of encoders is positioned adjacent to the traveling bowl for performing a second data acquisition about the subsystem; a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the subsystem; and a base plate located downstream from the fixed bowl and coupled with the plurality of hydraulic cylinders, wherein a fourth encoder of the plurality of encoders is positioned adjacent to the base plate for performing a fourth data acquisition about the subsystem or a tubular rack for facilitating operation of the subsystem.

Example 7 is the system of example 6, wherein a combination of the first data acquisition, the second data acquisition, the third data acquisition, and the fourth data acquisition are included in the multi-dimensional data acquisition and are performable to generate multi-dimensional information about the subsystem.

Example 8 is a system comprising: a hydraulic workover unit, the hydraulic workover unit positionable in a well system that includes a wellbore, the hydraulic workover unit comprising a plurality of subcomponents to facilitate an automated tripping operation with respect to the wellbore; and a plurality of encoders positionable in the hydraulic workover unit and distributable among the plurality of subcomponents to facilitate multi-dimensional data acquisition about the hydraulic workover unit for controlling the automated tripping operation.

Example 9 is the system of example 8, wherein the plurality of subcomponents comprises a jack rod that is located at an upstream position of the hydraulic workover unit with respect to the wellbore and between a traveling bowl and top plate of the hydraulic workover unit, wherein a subset of the plurality of encoders is positioned adjacent to the jack rod, and wherein the subset of the plurality of encoders is arranged to be used to perform data acquisition about a diameter of the jack rod and a displacement of the jack rod with respect to the hydraulic workover unit.

Example 10 is the system of example 8, wherein the plurality of subcomponents comprises a traveling bowl that is located at an upstream position of the hydraulic workover unit above one or more jack rods of the hydraulic workover unit, wherein a subset of the plurality of encoders is positioned adjacent to the traveling bowl, and wherein the subset of the plurality of encoders is arranged to be used to perform data acquisition about an instantaneous change in diameter of a pipe associated with the hydraulic workover unit.

Example 11 is the system of example 8, wherein the plurality of subcomponents comprises a fixed bowl that is located between a top plate and a base plate of the hydraulic workover unit, wherein a subset of the plurality of encoders is positioned adjacent to the fixed bowl, and wherein the subset of the plurality of encoders is arranged to be used to perform data acquisition about an instantaneous change in diameter of a pipe associated with the hydraulic workover unit, about a direction and magnitude of linear displacement of the pipe, and about an incremental speed of motion of the pipe.

Example 12 is the system of example 8, wherein the plurality of subcomponents comprises a base plate that is located at a downstream end of the hydraulic workover unit, wherein a subset of the plurality of encoders is positioned adjacent to the base plate, and wherein the subset of the plurality of encoders is arranged to be used to perform data acquisition about an instantaneous change in diameter of a pipe associated with the hydraulic workover unit, about a direction and magnitude of linear displacement of the pipe, and about an incremental speed of motion of the pipe.

Example 13 is the system of example 8, wherein the plurality of subcomponents comprises: a plurality of hydraulic jacks located around a central axis and translatable within a plurality of hydraulic cylinders of the hydraulic workover unit, wherein a first encoder of the plurality of encoders is positioned adjacent to the plurality of hydraulic jacks for performing a first data acquisition about the hydraulic workover unit; a traveling bowl located upstream with respect to the wellbore from the plurality of hydraulic jacks, wherein a second encoder of the plurality of encoders is positioned adjacent to the traveling bowl for performing a second data acquisition about the hydraulic workover unit; a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the hydraulic workover unit; and a base plate located downstream from the fixed bowl and coupled with the plurality of hydraulic cylinders, wherein a fourth encoder of the plurality of encoders is positioned adjacent to the base plate for performing a fourth data acquisition about the hydraulic workover unit or a tubular rack for facilitating operation of the hydraulic workover unit.

Example 14 is the system of example 13, wherein a combination of the first data acquisition, the second data acquisition, the third data acquisition, and the fourth data acquisition are included in the multi-dimensional data acquisition and are performable to generate multi-dimensional information about the hydraulic workover unit.

Example 15 is a method comprising: positioning a plurality of encoders on a subsystem that comprises a coiled tubing or a hydraulic workover, the plurality of encoders distributed among a plurality of subcomponents of the subsystem; positioning the subsystem on a well system that includes a wellbore; and performing an automatic tripping operation with respect to the wellbore using the subsystem, the automatic tripping operation involving performing multi-dimensional data acquisition about the subsystem using the plurality of encoders for controlling the automated tripping operation.

Example 16 is the method of example 15, wherein the plurality of subcomponents comprises a jack rod that is located at an upstream position of the subsystem with respect to the wellbore and between a traveling bowl and top plate of the subsystem, wherein a subset of the plurality of encoders is positioned adjacent to the jack rod, and wherein performing the automatic tripping operation comprises using the subset of the plurality of encoders to perform data acquisition about a diameter of the jack rod and a displacement of the jack rod with respect to the subsystem.

Example 17 is the method of example 15, wherein the plurality of subcomponents comprises a traveling bowl that is located at an upstream position of the subsystem above one or more jack rods of the subsystem, wherein a subset of the plurality of encoders is positioned adjacent to the traveling bowl, and wherein performing the automatic tripping operation comprises using the subset of the plurality of encoders to perform data acquisition about an instantaneous change in diameter of a pipe associated with the subsystem.

Example 18 is the method of example 15, wherein the plurality of subcomponents comprises a fixed bowl that is located between a top plate and a base plate of the subsystem, wherein a subset of the plurality of encoders is positioned adjacent to the fixed bowl, and wherein performing the automatic tripping operation comprises using the subset of the plurality of encoders to: perform data acquisition about an instantaneous change in diameter of a pipe associated with the subsystem; perform data acquisition about a direction and magnitude of linear displacement of the pipe; and perform data acquisition about an incremental speed of motion of the pipe.

Example 19 is the method of example 15, wherein the plurality of subcomponents comprises a base plate that is located at a downstream end of the subsystem, wherein a subset of the plurality of encoders is positioned adjacent to the base plate, and wherein performing the automatic tripping operation comprises using the subset of the plurality of encoders to: perform data acquisition about an instantaneous change in diameter of a pipe associated with the subsystem; perform data acquisition about a direction and magnitude of linear displacement of the pipe; and perform data acquisition about an incremental speed of motion of the pipe.

Example 20 is the method of example 15, wherein the plurality of subcomponents comprises: a plurality of hydraulic jacks located around a central axis and arranged to be translated within a plurality of hydraulic cylinders of the subsystem, wherein a first encoder of the plurality of encoders is positioned adjacent to the plurality of hydraulic jacks for performing a first data acquisition about the subsystem; a traveling bowl located upstream with respect to the wellbore from the plurality of hydraulic jacks, wherein a second encoder of the plurality of encoders is positioned adjacent to the traveling bowl for performing a second data acquisition about the subsystem; a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the subsystem; and a base plate located downstream from the fixed bowl and coupled with the plurality of hydraulic cylinders, wherein a fourth encoder of the plurality of encoders is positioned adjacent to the base plate for performing a fourth data acquisition about the subsystem or a tubular rack for facilitating operation of the subsystem, wherein performing the automatic tripping operation comprises generating multi-dimensional information about the subsystem using the multi-dimensional data acquisition that comprises a combination of the first data acquisition, the second data acquisition, third data acquisition, and the fourth data acquisition.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a subsystem comprising a coiled tubing or a hydraulic workover positionable on a well system that includes a wellbore, the subsystem comprising a plurality of subcomponents to facilitate an automated tripping operation with respect to the wellbore, the plurality of subcomponents comprising a rod, a traveling bowl, and a plate, the rod being located between the traveling bowl and the plate, and the rod located at an upstream position of the subsystem with respect to the wellbore; and a plurality of encoders positionable in the subsystem and distributable among the plurality of subcomponents to facilitate multi-dimensional data acquisition about the subsystem for controlling the automated tripping operation, a subset of the plurality of encoders being positioned adjacent to the rod, and the subset of the plurality of encoders arranged to be used to perform data acquisition about a diameter of the rod and a displacement of the rod with respect to the subsystem.

2. The system of claim 1, wherein the traveling bowl located at an upstream position of the subsystem above one or more jack rods of the subsystem, wherein a subset of the plurality of encoders is positioned adjacent to the traveling bowl, and wherein the subset of the plurality of encoders is arranged to be used to perform data acquisition about an instantaneous change in diameter of a pipe associated with the subsystem.

3. The system of claim 1, wherein the plurality of subcomponents comprises a fixed bowl that is located between a top plate and a base plate of the subsystem, wherein a subset of the plurality of encoders is positioned adjacent to the fixed bowl, and wherein the subset of the plurality of encoders is arranged to be used to perform data acquisition about an instantaneous change in diameter of a pipe associated with the subsystem, about a direction and magnitude of linear displacement of the pipe, and about an incremental speed of motion of the pipe.

4. The system of claim 1, wherein the plurality of subcomponents comprises a base plate that is located at a downstream end of the subsystem, wherein a subset of the plurality of encoders is positioned adjacent to the base plate, and wherein the subset of the plurality of encoders is arranged to be used to perform data acquisition about an instantaneous change in diameter of a pipe associated with the subsystem, about a direction and magnitude of linear displacement of the pipe, and about an incremental speed of motion of the pipe.

5. The system of claim 1, wherein the plurality of subcomponents comprises:

a plurality of hydraulic jacks located around a central axis and translatable within a plurality of hydraulic cylinders of the subsystem, wherein a first encoder of the plurality of encoders is positioned adjacent to the plurality of hydraulic jacks for performing a first data acquisition about the subsystem;

a traveling bowl located upstream with respect to the wellbore from the plurality of hydraulic jacks, wherein a second encoder of the plurality of encoders is positioned adjacent to the traveling bowl for performing a second data acquisition about the subsystem;

a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the subsystem; and a base plate located downstream from the fixed bowl and coupled with the plurality of hydraulic cylinders, wherein a fourth encoder of the plurality of encoders is positioned adjacent to the base plate for performing a fourth data acquisition about the subsystem or a tubular rack for facilitating operation of the subsystem.

6. The system of claim 5, wherein a combination of the first data acquisition, the second data acquisition, the third data acquisition, and the fourth data acquisition are included in the multi-dimensional data acquisition and are performable to generate multi-dimensional information about the subsystem.

7. A system comprising:

a hydraulic workover unit, the hydraulic workover unit positionable in a well system that includes a wellbore, the hydraulic workover unit comprising a plurality of subcomponents to facilitate an automated tripping operation with respect to the wellbore, the plurality of subcomponents comprising a rod, a traveling bowl, and a plate, and the rod being located between the traveling bowl and the plate, and the rod located at an upstream position of the hydraulic workover unit with respect to the wellbore; and a plurality of encoders positionable in the hydraulic workover unit and distributable among the plurality of subcomponents to facilitate multi-dimensional data acquisition about the hydraulic workover unit for controlling the automated tripping operation, a subset of the plurality of encoders being positioned adjacent to the rod, and the subset of the plurality of encoders arranged to be used to perform data acquisition about a diameter of the rod and a displacement of the rod with respect to the hydraulic workover unit.

8. The system of claim 7, wherein the traveling bowl located at an upstream position of the hydraulic workover unit above one or more jack rods of the hydraulic workover unit, wherein a subset of the plurality of encoders is positioned adjacent to the traveling bowl, and wherein the subset of the plurality of encoders is arranged to be used to perform data acquisition about an instantaneous change in diameter of a pipe associated with the hydraulic workover unit.

9. The system of claim 7, wherein the plurality of subcomponents comprises a fixed bowl that is located between a top plate and a base plate of the hydraulic workover unit, wherein a subset of the plurality of encoders is positioned adjacent to the fixed bowl, and wherein the subset of the plurality of encoders is arranged to be used to perform data acquisition about an instantaneous change in diameter of a pipe associated with the hydraulic workover unit, about a direction and magnitude of linear displacement of the pipe, and about an incremental speed of motion of the pipe.

10. The system of claim 7, wherein the plurality of subcomponents comprises a base plate that is located at a downstream end of the hydraulic workover unit, wherein a subset of the plurality of encoders is positioned adjacent to the base plate, and wherein the subset of the plurality of encoders is arranged to be used to perform data acquisition about an instantaneous change in diameter of a pipe associated with the hydraulic workover unit, about a direction and magnitude of linear displacement of the pipe, and about an incremental speed of motion of the pipe.

11. The system of claim 7, wherein the plurality of subcomponents comprises:

a plurality of hydraulic jacks located around a central axis and translatable within a plurality of hydraulic cylinders of the hydraulic workover unit, wherein a first encoder of the plurality of encoders is positioned adjacent to the plurality of hydraulic jacks for performing a first data acquisition about the hydraulic workover unit;

a traveling bowl located upstream with respect to the wellbore from the plurality of hydraulic jacks, wherein a second encoder of the plurality of encoders is positioned adjacent to the traveling bowl for performing a second data acquisition about the hydraulic workover unit;

a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the hydraulic workover unit; and a base plate located downstream from the fixed bowl and coupled with the plurality of hydraulic cylinders, wherein a fourth encoder of the plurality of encoders is positioned adjacent to the base plate for performing a fourth data acquisition about the hydraulic workover unit or a tubular rack for facilitating operation of the hydraulic workover unit.

12. The system of claim 11, wherein a combination of the first data acquisition, the second data acquisition, the third data acquisition, and the fourth data acquisition are included in the multi-dimensional data acquisition and are performable to generate multi-dimensional information about the hydraulic workover unit.

13. A method comprising:

positioning a plurality of encoders on a subsystem that comprises a coiled tubing or a hydraulic workover, the plurality of encoders distributed among a plurality of subcomponents of the subsystem, the plurality of subcomponents comprising a rod, a traveling bowl, and a plate, the rod being located between the traveling bowl and the plate, and a subset of the plurality of encoders being positioned adjacent to the rod, the rod located at an upstream position of the subsystem with respect to a wellbore, and the subset of the plurality of encoders arranged to be used to perform data acquisition about a diameter of the rod and a displacement of the rod with respect to the subsystem;

positioning the subsystem on a well system that includes the wellbore; and performing an automatic tripping operation with respect to the wellbore using the subsystem, the automatic tripping operation involving performing multi-dimensional data acquisition about the subsystem using the plurality of encoders for controlling the automated tripping operation.

14. The method of claim 13, wherein the traveling bowl is located at an upstream position of the subsystem above one or more jack rods of the subsystem, wherein a subset of the plurality of encoders is positioned adjacent to the traveling bowl, and wherein performing the automatic tripping operation comprises using the subset of the plurality of encoders to perform data acquisition about an instantaneous change in diameter of a pipe associated with the subsystem.

15. The method of claim 13, wherein the plurality of subcomponents comprises a fixed bowl that is located between a top plate and a base plate of the subsystem, wherein a subset of the plurality of encoders is positioned adjacent to the fixed bowl, and wherein performing the automatic tripping operation comprises using the subset of the plurality of encoders to:

perform data acquisition about an instantaneous change in diameter of a pipe associated with the subsystem;

perform data acquisition about a direction and magnitude of linear displacement of the pipe; and perform data acquisition about an incremental speed of motion of the pipe.

16. The method of claim 13, wherein the plurality of subcomponents comprises a base plate that is located at a downstream end of the subsystem, wherein a subset of the plurality of encoders is positioned adjacent to the base plate, and wherein performing the automatic tripping operation comprises using the subset of the plurality of encoders to:

perform data acquisition about an instantaneous change in diameter of a pipe associated with the subsystem;

perform data acquisition about a direction and magnitude of linear displacement of the pipe; and perform data acquisition about an incremental speed of motion of the pipe.

17. The method of claim 13, wherein the plurality of subcomponents comprises:

a plurality of hydraulic jacks located around a central axis and arranged to be translated within a plurality of hydraulic cylinders of the subsystem, wherein a first encoder of the plurality of encoders is positioned adjacent to the plurality of hydraulic jacks for performing a first data acquisition about the subsystem;

a traveling bowl located upstream with respect to the wellbore from the plurality of hydraulic jacks, wherein a second encoder of the plurality of encoders is positioned adjacent to the traveling bowl for performing a second data acquisition about the subsystem;

a fixed bowl located downstream from the plurality of hydraulic jacks and coupled with the plurality of hydraulic cylinders, wherein a third encoder of the plurality of encoders is positioned adjacent to the fixed bowl for performing a third data acquisition about the subsystem; and a base plate located downstream from the fixed bowl and coupled with the plurality of hydraulic cylinders, wherein a fourth encoder of the plurality of encoders is positioned adjacent to the base plate for performing a fourth data acquisition about the subsystem or a tubular rack for facilitating operation of the subsystem, wherein performing the automatic tripping operation comprises generating multi-dimensional information about the subsystem using the multi-dimensional data acquisition that comprises a combination of the first data acquisition, the second data acquisition, third data acquisition, and the fourth data acquisition.

* * * * *